US006548950B2

(12) United States Patent
Kobayashi et al.

(10) Patent No.: US 6,548,950 B2
(45) Date of Patent: Apr. 15, 2003

(54) CATHODE RAY TUBE HAVING SHADOW MASK WITH SLIT BETWEEN APERTURES

(75) Inventors: Hiroshi Kobayashi, Osaka (JP); Masayuki Ohmori, Osaka (JP); Yoshikazu Demi, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 54 days.

(21) Appl. No.: 09/782,208

(22) Filed: Feb. 13, 2001

(65) Prior Publication Data

US 2001/0015607 A1 Aug. 23, 2001

(30) Foreign Application Priority Data

Feb. 17, 2000 (JP) ..... 2000-040007

(51) Int. Cl.[7] ..... H01J 29/80
(52) U.S. Cl. ..... 313/403; 313/402

(58) Field of Search ..... 313/402, 403

*Primary Examiner*—Vip Patel
(74) *Attorney, Agent, or Firm*—Merchant & Gould, P.C.

(57) ABSTRACT

A cathode ray tube capable of preventing incorrect hitting of color electron beams caused by the local doming phenomenon and the initial doming phenomenon from occurring and thus preventing displacement of colors, unevenness in colors, and deterioration of luminance from occurring is provided. The cathode ray tube includes a shadow mask made of a flat plate in which a number of apertures 2 are arranged in lines, and slits 5, 6 are formed in the line direction of the apertures 2. These slits 5, 6 have inclined faces 8, 9, 11 and 12 opposed via openings 10, 13. Due to this configuration, the displacement of apertures due to the local doming phenomenon or the initial doming phenomenon caused by the thermal expansion of the shadow mask can be suppressed. Thus, displacement of colors, unevenness in colors, and deterioration of luminance caused by incorrect hitting of electron beams can be prevented from occurring.

7 Claims, 5 Drawing Sheets

CATHODE RAY TUBE HAVING SHADOW MASK WITH SLIT BETWEEN APERTURES

BACKGROUND OF THE INVENTION

1. Field of the Invention

The present invention relates to a shadow mask type cathode ray tube, which is used for a television receiver, a computer display, and the like.

2. Description of the Related Art

FIG. 4 is a cross-sectional view showing one example of a conventional color cathode ray tube. The color cathode ray tube 41 shown in FIG. 4 includes a substantially rectangular-shaped face panel 42 having a phosphor screen formed on its inner face, a funnel 43 connected to the rear side of the face panel 42, an electron gun 44 contained in a neck portion 43*a* of the funnel 43, a shadow mask 46 facing the phosphor screen 42*a* inside the face panel 42, and a mask frame 47 for fixing the shadow mask 46. Furthermore, in order to deflect and scan electron beams, a deflection yoke 45 is provided on the outer periphery of the funnel 43.

The shadow mask 46 plays a role of selecting colors with respect to three electron beams emitted from the electron gun 44. "A" shows a track of the electron beams. The shadow mask is a flat plate in which a number of apertures, through which electron beams pass, are formed by etching.

In a color cathode ray tube, due to the thermal expansion caused by the impact of the emitted electron beams, the electron beam through aperture is shifted. Consequently, a doming phenomenon occurs. That is, the electron beams passing through the electron beam through apertures fail to hit a predetermined phosphor correctly, thus causing unevenness in colors. Therefore, a tension force to absorb the thermal expansion due to the temperature increase of the shadow mask is applied in advance, and then the shadow mask is stretched and held to the mask frame. When the shadow mask is stretched and held as mentioned above, even if the temperature of the shadow mask is raised, it is possible to reduce the amount of displacement between an aperture of the shadow mask and phosphor stripes of the phosphor screen.

However, the conventional color cathode ray tube described above suffered from the following problem. FIG. 5 is a plan view showing a part of an example of a conventional shadow mask. In a shadow mask 20, a number of apertures 21 are formed in lines. The apertures 21 neighboring in the vertical direction (vertical direction of the screen) are connected by a bridge 22. With regard to the shadow mask illustrated in FIG. 5, due to the thermal expansion of the shadow mask 20 caused by the impact of the emitted electron beams, for example, in an area B, which is a portion between the neighboring aperture lines, stress is applied in the direction indicated by arrow d. When such stress is applied, wrinkles are created in the area B, and the aperture 21 is shifted in the horizontal direction. When such a so-called local doming phenomenon occurs, electron beams do not hit the shadow mask correctly, thus causing displacement of colors, unevenness in colors, and deterioration of luminance.

Furthermore, the thickness of the shadow mask is extremely small (for example, about 0.1 mm) compared to the thickness of the mask frame to which the shadow mask is fixed. Therefore, in the initial stage of operating the color cathode ray tube, a so-called initial doming phenomenon occurs, in which only the shadow mask expands thermally.

When this initial doming phenomenon occurs, the lines of the aperture are shifted in the horizontal direction, so that electron beams do not hit the shadow mask correctly, thus causing displacement of colors, unevenness in colors, and deterioration of luminance. Such problems caused by the local doming phenomenon or the initial doming phenomenon could not be prevented sufficiently even by stretching and holding the shadow mask as described above.

SUMMARY OF THE INVENTION

It is an object of the present invention to solve the conventional problems described above by providing a cathode ray tube in which a slit is formed between aperture lines, thereby preventing incorrect hitting of color electron beams caused by the local doming phenomenon and the initial doming phenomenon from occurring and thus preventing displacement of colors, unevenness in colors, and deterioration of luminance from occurring.

To achieve the above object, the cathode ray tube of the present invention is characterized by including a shadow mask made of a flat plate in which a number of aperture lines are arranged, wherein a slit extending in the line direction of the apertures is formed between the neighboring aperture lines. According to the cathode ray tube described above, it is possible to suppress the displacement of apertures due to the local doming phenomenon or the initial doming phenomenon caused by the thermal expansion of the shadow mask, and thus to prevent displacement of colors, unevenness in colors, and deterioration of luminance caused by incorrect hitting of electron beams from occurring.

In the cathode ray tube described above, it is preferable that the slit includes a slit having inclined faces opposed to each other via an opening, and the inclined faces are formed at an angle inclined such that electron beams entering the shadow mask are blocked.

Furthermore, it is preferable that the slit described above includes a slit having inclined faces opposed to each other via an opening, and the inclined faces are inclined toward the side of a vertical center line of the shadow mask by taking a rear face of the shadow mask as the starting point. According to the cathode ray tube including the shadow mask provided with the slit having inclined faces as described above, electron beams are blocked surely in the portion where the slit is formed. Therefore, while incorrect hitting of electron beams can be prevented, with regard to passing of electron beams, this shadow mask is substantially equivalent to a shadow mask in which a slit is not formed.

Moreover, it is preferable that a connected portion is further provided for linking the inclined faces opposed to each other at one portion of each inclined face. According to the cathode ray tube described above, electron beams are blocked even more surely in the portion where the slit is formed.

Furthermore, a plurality of slits described above preferably are formed separately in the line direction of the apertures. According to the shadow mask described above, while the displacement of apertures caused by the thermal expansion of the shadow mask can be suppressed, a number of bridge for linking upper and lower slits is increased, so that the hardness of the shadow mask can be secured more easily, and at the same time, the surfaces of the shadow mask located on the right and left sides of the slits are less likely to be entwined.

DETAILED DESCRIPTION OF THE INVENTION

Figure 4:
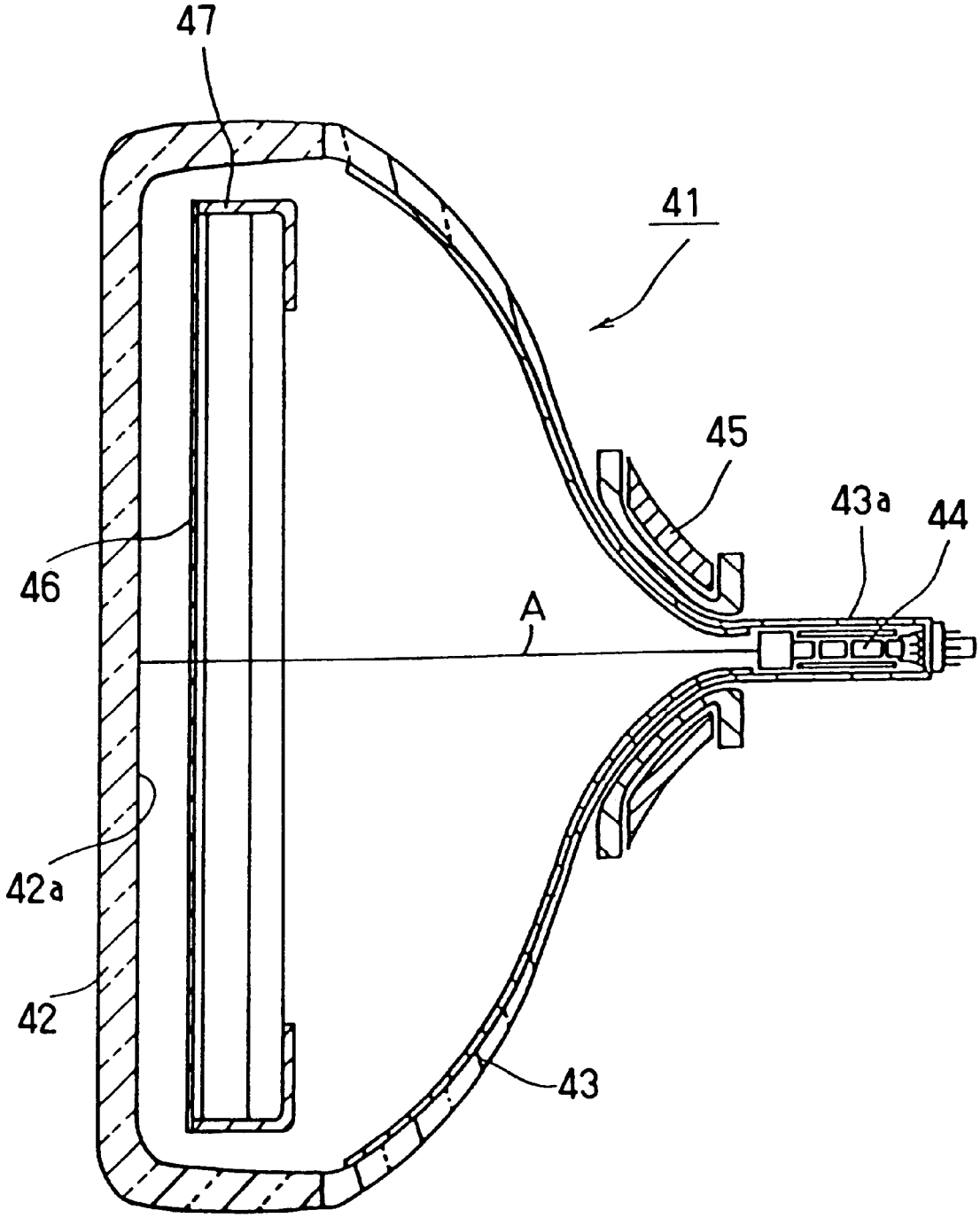
FIG. 4 is a cross-sectional view showing an example of a color cathode ray tube.
Figure 5:
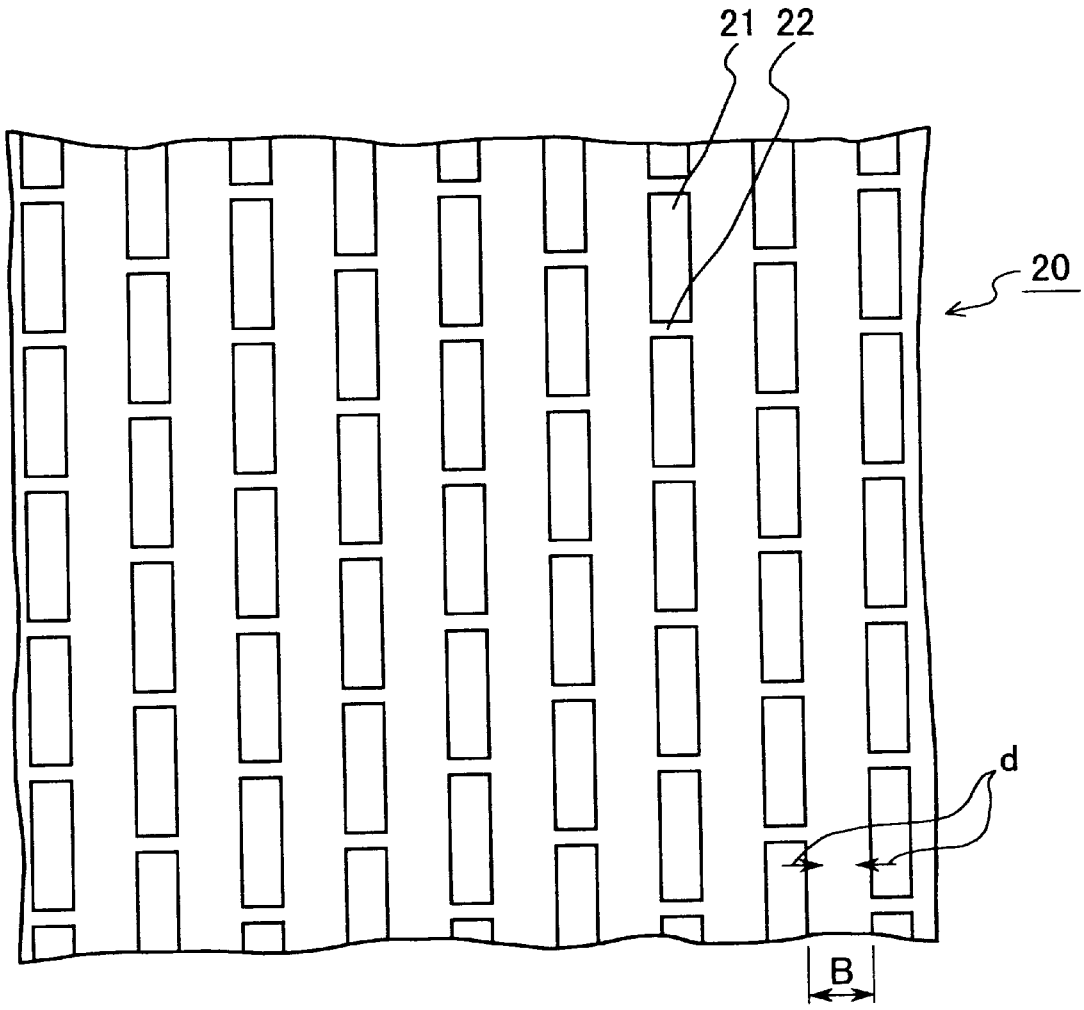
FIG. 5 is a plan view showing an example of a conventional shadow mask.

Hereinafter, one embodiment of the present invention will be described with reference to the drawings. Since each construction of the color cathode ray tube described with reference to FIG. 4 is the same as that in this embodiment, the explanations thereof are not repeated herein.

Figure 1:
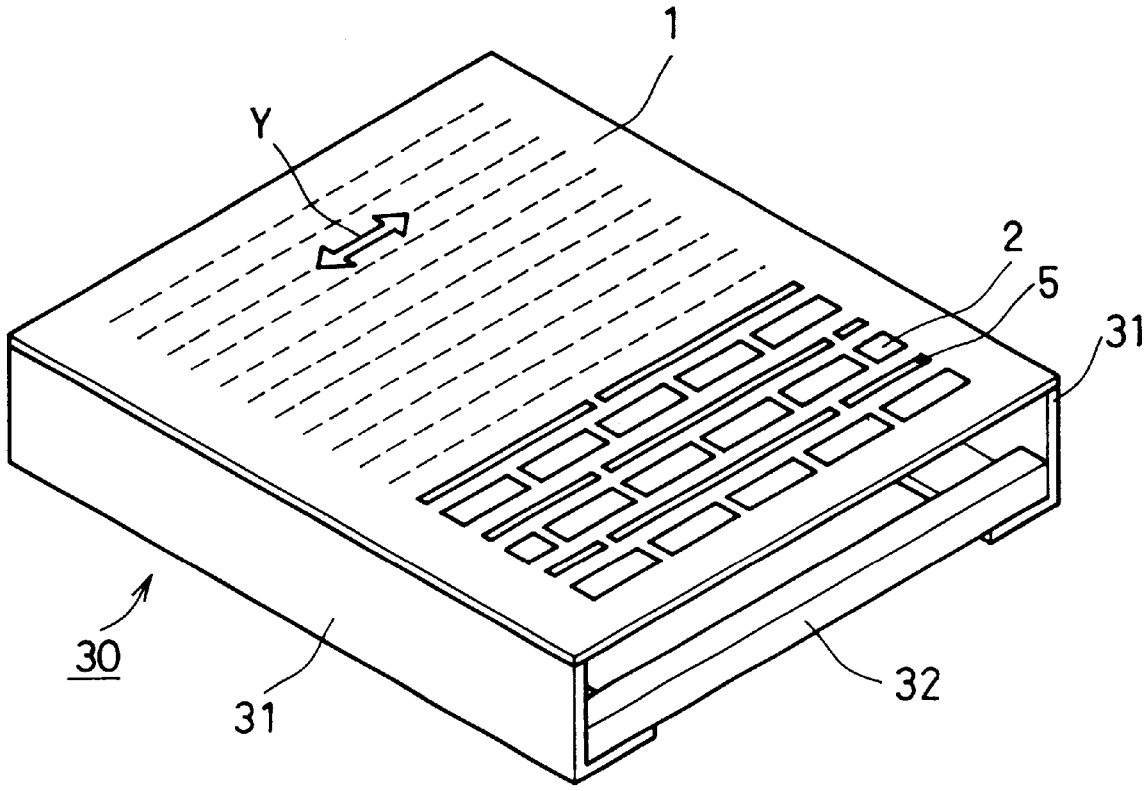
FIG. 1 is a perspective view showing a color-selecting electrode of one embodiment of the present invention.

FIG. 1 is a perspective view showing one embodiment of a color-selecting electrode. A mask frame 30 is a rectangular frame and is made of a pair of long frame supports 31, facing each other, fixed to a pair of short frames made of elastic members 32. The shadow mask 1 is held between the supports 31. In the shadow mask 1, apertures 2, through which electron beams pass, are formed by etching. As will be explained specifically later, a slit 5 is formed between the lines of the apertures 2. In this drawing, a tension method is employed, and the shadow mask 1 is stretched and held between the supports 31 with a tension force applied mainly in the direction indicated by arrow Y.

Figure 2:
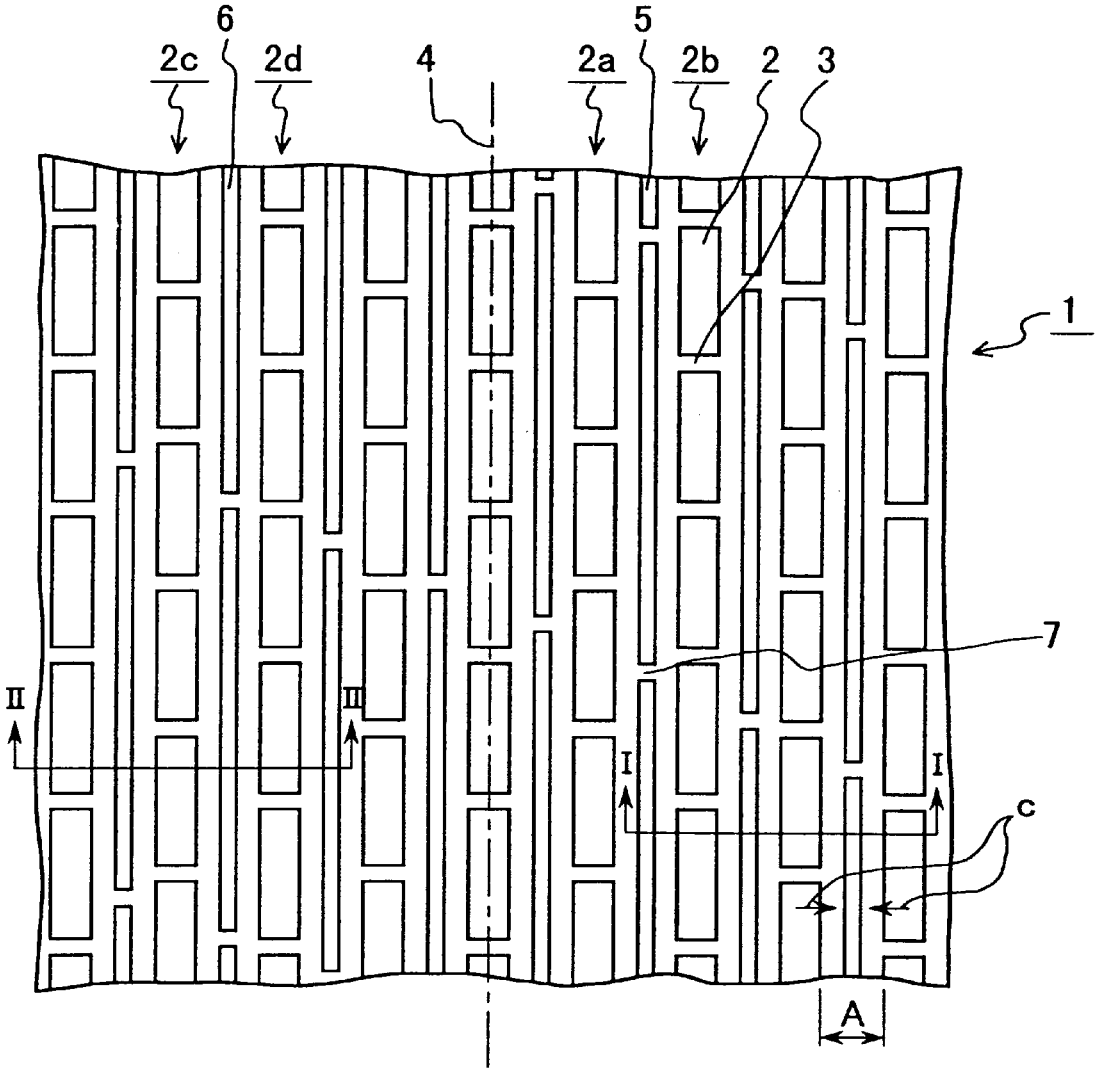
FIG. 2 is a plan view showing a shadow mask of one embodiment of the present invention.

FIG. 2 is a plan view showing a part of one embodiment of a shadow mask according to the present invention. In the shadow mask 1, a number of apertures 2 are formed in lines, and the apertures 2 neighboring in the vertical direction of the shadow mask 1 (vertical direction of the screen) are linked by a bridge 3. A line 4 shows the vertical center line of the shadow mask 1.

Seen from the phosphor screen 42*a* (FIG. 4), the slit 5 is formed in the right area (hereinafter, this area is referred to as "right area") and a slit 6 is formed in the left area (hereinafter, this area is referred to as "left area") respectively. The slits 5, 6 are formed between the neighboring lines of the apertures 2. For example, the slit 5 is formed between an aperture line 2*a* and an aperture line 2*b* in the right area, and the slit 6 is formed between an aperture line 2*c* and an aperture line 2*d* in the left area.

Such slits can be formed by etching just like forming the apertures 2, and they also can be formed by laser processing. In the example illustrated in FIG. 2, the slits 5, 6 neighboring in the vertical direction are linked by a bridge 7.

Figure 3A:
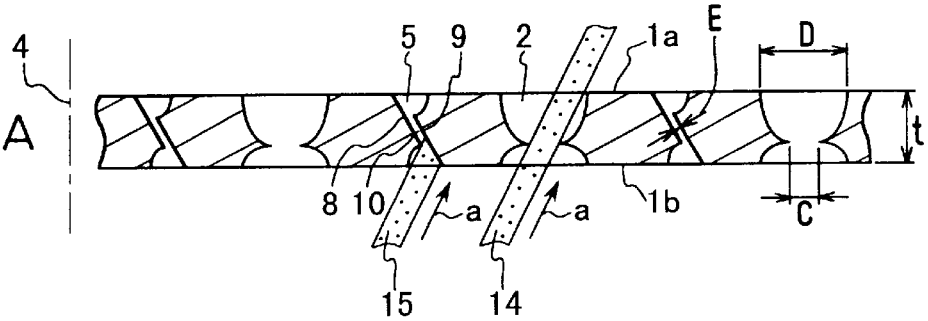
FIG. 3A is a cross-sectional view taken on line I—I of FIG. 2.
Figure 3B:
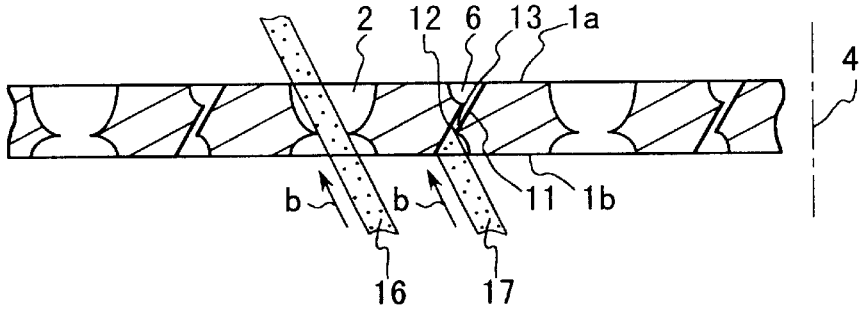
FIG. 3B is a cross-sectional view taken on line II—II of FIG. 2.

FIG. 3 is a cross-sectional view of the shadow mask shown in FIG. 2 taken in the horizontal direction (horizontal direction of the screen). FIG. 3A is a cross-sectional view taken on line I—I of FIG. 2, that is, a cross-sectional view in the right area, and FIG. 3B is a cross-sectional view taken on line II—II of FIG. 2, that is, a cross-sectional view in the left area.

As illustrated in FIG. 3A, the slit 5 in the right area has an inclined face 8 and an inclined face 9 opposed to each other via an opening 10. As for the direction of inclination of the inclined faces 8, 9, the inclined faces 8, 9 start to incline from a rear face 1*b* of the shadow mask 1 and incline toward the side of the vertical center line 4 as they approach a surface 1*a*. As illustrated in FIG. 3B, the slit 6 in the left area has an inclined face 11 and an inclined face 12 opposed to each other via an opening 13. As for the direction of inclination of the inclined faces 11, 12, the inclined faces 11, 12 start to incline from the rear face 1*b* of the shadow mask 1 and incline toward the side of the vertical center line 4 as they approach the surface 1*a*.

Here, for example, in an area A (FIG. 2), which is a portion between the neighboring aperture lines, the both sides located horizontally are supported by the bridge 7. Consequently, as described above, due to the thermal expansion of the shadow mask 1 caused by the impact of the emitted electron beams, stress is applied in the direction indicated by arrow c in the area A.

In the present embodiment, the slit 5 is formed between the lines of the apertures 2, so that such stress is effected in the direction of reducing the width of the slit 5 and is absorbed by the deformation of the slit 5.

In other words, according to the present embodiment, it is possible to suppress the displacement of apertures due to the local doming phenomenon or the initial doming phenomenon caused by the thermal expansion of the shadow mask. As a result, displacement of colors, unevenness in colors, and deterioration of luminance caused by incorrect hitting of electron beams can be prevented from occurring.

Furthermore, as illustrated in FIG. 3A, electron beams are propagated in the direction indicated by arrow a in the right area. In this case, a light beam 14 passes through the aperture 2, but a light beam 15 is blocked by the inclined face 9 of the slit 5. This configuration also applies to the left area. As illustrated in FIG. 3B, electron beams are propagated in the direction indicated by arrow b in the left area. A light beam 16 passes through the aperture 2, but a light beam 17 is blocked by the inclined face 12 of the slit 6. In other words, in the present embodiment, although the slits are formed between the aperture lines, electron beams are blocked in the portion where the slits are formed. Therefore, with regard to passing of light beams, this shadow mask is substantially equivalent to a shadow mask in which the slits are not formed.

Furthermore, in FIG. 3A, a thickness t of the shadow mask preferably is in the range between 0.05 and 0.25 mm, and a width C of the aperture preferably is in the range between 0.7t and 2t, and a width D preferably is in the range between 1.2C and 2.5C. Also, a width E of the slit preferably is in the range between 0.1t and 0.8t.

Figure 3C:
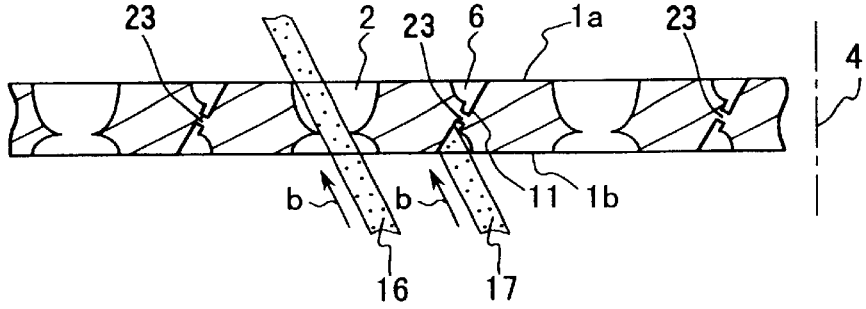
FIG. 3C is a cross-sectional view of an embodiment provided with a connected portion in the slit.

Additionally, in the above embodiment, the slit was explained by referring to the case in which the slit penetrates completely from the surface to the rear face of the shadow mask, but there also may be a minute connected portion 23 formed in the opening for linking the opposed inclined faces as illustrated in FIG. 3C. Also in this case, the effect of absorbing stress can be achieved, and light is blocked even more surely. In this case, in the vertical direction of the screen, the connected portion 23 may be formed successively over the entire slits and also partially or intermittently. It may be determined appropriately in the range in which both the effect of absorbing stress and the shielding effect can be achieved at the same time.

Moreover, the inclined angle of the slit is not limited to the example illustrated in FIG. 3. The inclined angle may be determined suitably in the range in which stress can be absorbed and electron beams can be blocked. For example, with regard to the vicinity of the vertical center line 4, the inclined direction of the slit may be determined to be opposite to the example illustrated in FIG. 3. Namely, as for the direction of inclination of the inclined faces, the inclined faces may start to incline from the rear face 1*b* of the shadow mask 1 and incline toward the side away from the vertical center line 4 as they approach the surface 1*a*. Furthermore, the slit also may be formed with the vertical faces opposed to each other.

Furthermore, it was explained by referring to the case in which the slits neighboring in the vertical direction are linked by a bridge and the slit is formed separately in plurality in the line direction of the apertures, but each line may be formed as one slit.

Moreover, the present embodiment was described under the condition that the shadow mask is stretched and held. However, even if the shadow mask is not stretched and held, the effect of absorbing stress as described above can be obtained. Therefore, the present embodiment also is applicable to a shadow mask provided with a curved surface formed by press molding, which is not stretched and held.

Moreover, in the example illustrated in FIG. 1, the slit 5 is formed between the lines of the apertures 2, but the slit 5 may be further provided in the area between the lines of the apertures 2 on the both sides and the right and left edges of the shadow mask.

As described above, according to the cathode ray tube of the present invention, in the shadow mask made of a flat plate in which a number of aperture lines are arranged, a slit is formed between the neighboring aperture lines. As a result, the displacement of apertures due to the local doming phenomenon or the initial doming phenomenon caused by the thermal expansion of the shadow mask can be suppressed. Thus, displacement of colors, unevenness in colors, and deterioration of luminance caused by incorrect hitting of electron beams can be prevented from occurring.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a shadow mask made of a flat plate in which a number of aperture lines are arranged, the shadow mask having a front side and a rear side, and wherein the shadow mask has an area where a slit extending in a direction of the aperture lines is formed between the neighboring aperture lines and the slit penetrates from the front side to the rear side of the shadow mask.

2. The cathode ray tube according to claim 1, wherein the slit includes a slit having inclined faces opposed to each other via an opening, and the inclined faces are formed at an angle inclined such that electron beams entering the shadow mask are blocked.

3. A cathode ray tube comprising:

a shadow mask made of a flat plate in which a number of aperture lines are arranged, the shadow mask having a front side and a rear side, an area on the shadow mask where a slit extending in a direction of the aperture lines is formed between the neighboring aperture lines, wherein the slit has inclined faces opposed to each other via an opening and the inclined faces are formed at an angle inclined such that electron beams entering the shadow mask are blocked, and a connected portion that links a portion of a slit that is formed on the front side of the shadow mask with a portion of a slit that is formed on the rear side of the shadow mask.

4. The cathode ray tube according to claim 1, wherein the slit includes a slit having inclined faces opposed to each other via an opening, and the inclined faces are inclined toward the side of a vertical center line of the shadow mask by taking a rear face of the shadow mask as the starting point.

5. The cathode ray tube according to claim 4 further comprising a connected portion for linking the inclined faces opposed to each other at one portion of each inclined face.

6. The cathode ray tube according to claim 1, wherein a plurality of the slits are formed separately in the line direction of the apertures.

7. The cathode ray tube according to claim 3, wherein, when viewed as a cross-section of a shadow mask in a direction orthogonal to the line direction of the apertures, a center line of the connected portion is inclined with respect to a direction orthogonal to the line direction of the apertures.

* * * * *